US006171709B1

(12) United States Patent
Koizumi et al.

(10) Patent No.: US 6,171,709 B1
(45) Date of Patent: Jan. 9, 2001

(54) SUPER-ABRASIVE GRAIN-CONTAINING COMPOSITE MATERIAL AND METHOD OF MAKING

(75) Inventors: Mitsue Koizumi, Toyonaka; Manshi Ohyanagi, Ootsu; Satoru Hosomi, Oyama, all of (JP); Evgeny A. Levashov, Moscow (RU); Alexander V. Trotsue, Moscow (RU); Inna P. Borovinskaya, Moscow (RU)

(73) Assignees: The Ishizuka Research Institute, Ltd., Kanagawa-Ken; Mitsue Koizumi, Osaka-fu; Manshi Ohyanagi, Shiga-Ken, all of (JP); Moscow Steel and Alloys Institute, SHS-Center, Moscow (RU)

( * ) Notice: Under 35 U.S.C. 154(b), the term of this patent shall be extended for 0 days.

(21) Appl. No.: 09/043,499

(22) PCT Filed: Sep. 27, 1995

(86) PCT No.: PCT/JP95/01961

§ 371 Date: May 11, 1998

§ 102(e) Date: May 11, 1998

(87) PCT Pub. No.: WO97/11803

PCT Pub. Date: Apr. 3, 1997

(51) Int. Cl.[7] ..... B22F 3/23

(52) U.S. Cl. ..... 428/545; 419/8; 419/10; 419/45

(58) Field of Search ..... 419/10, 45; 428/564, 428/551, 545

(56) References Cited

U.S. PATENT DOCUMENTS

| | | | | |
|---|---|---|---|---|
| 4,655,830 | * | 4/1987 | Akashi et al. | 75/233 |
| 4,695,321 | * | 9/1987 | Akashi et al. | 75/243 |
| 4,923,490 | * | 5/1990 | Johnson et al. | 51/298 |
| 5,304,342 | * | 4/1994 | Hall, Jr. et al. | 419/11 |
| 5,330,701 | * | 7/1994 | Shaw et al. | 419/10 |
| 5,641,921 | * | 6/1997 | Dennis et al. | 75/230 |

* cited by examiner

*Primary Examiner*—Ngoclan Mai
(74) *Attorney, Agent, or Firm*—Larson & Taylor PLC

(57) ABSTRACT

The invention provides a superabrasive containing composite product, comprising and/or prepared on the intense heating of an SHS process, self-propagating high-temperature synthesis. An effective method of such product is also provided. Said composite comprises a substrate of shaped metallic block and a functional layer of ceramic materials containing superabrasive particles, which is joined on a surface of the former, by means of and intermediated by molten metal which occurred during the SHS process.

20 Claims, 3 Drawing Sheets

SUPER-ABRASIVE GRAIN-CONTAINING COMPOSITE MATERIAL AND METHOD OF MAKING

TECHNICAL FIELD

This invention relates to a composite comprising wear-resistant material with superabrasive particles and ductile metal. Common structural metallic materials can be used to make the substrate, which may be a block in various forms (including plates), and they are prepared either through a compressive work such as forging, rolling, extrusion and HIPping or by foundry.

BACKGROUND TECHNIQUE

As wear-resistant materials comprising superabrasive particles, diamond or cubic boron nitride compacts are commercially produced mainly in ultrahigh pressure processes, and in which the superabrasive particles are joined immediately with each other or distributed in a ceramic matrix. While the compacts may be employed as a block of totally uniform structure, they are more commonly used as a composite with a carbide backing to which the superabrasive particles are joined during the sintering of the particles themselves. The latter composition is taken mainly as demanded in the subsequent steps of machining into the final shape or brazing to the support, where a less superabrasive thickness is favored for a higher efficiency, or a such backing facilitates the work.

However carbide alloy, being a hard and brittle material, cannot fully comply with the residual stresses which occur at the carbide and superabrasive interface after cooled down due to the difference in thermal expansion coefficient. They may eventually cause to disjoint the layers at a slightest external load.

Further, the use of carbide alloy is not advantageous for the rather high material cost and high specific gravity.

It is known to use a self-propagating high-temperature synthesis (SHS) for the preparation of some types of functional materials. The technique is based on the process which occurs with appropriate material systems: a combustion, once initiated by igniting at a spot, sustains itself and propagates throughout the rest of the material, due to an intense production of heat which spreads and causes a sufficient temperature rise. It is useful for the production of such compounds as, for example, carbide, nitride, boride, silicide or oxide of the fourth or fifth group metals of the periodic table, including Ti, Zr, Ta, Si, as well as intermetallic compounds. This technique is fully described in "The chemistry of SHS", published by T.I.C. (1992).

An SHS process, which can produce high temperatures over a short period of time almost adiabatically, is employed for the formation and sintering, simultaneous or subsequent, of high melting materials and, if tentatively, for the preparation of compact of various materials. For the materials, these techniques are available: static compression with a mechanical press, instantaneous compression by explosive detonation, isostatic compression with a HIP system, quasi HIP process whereby the formed compact is squeezed from around with a mechanical press in a die by means of molding sand.

One of the principal objects of the present invention is to eliminate the above described problems which are associated with conventional processes and products involving an ultrahigh pressure technique, and thereby to provide a heat-resistant product, and also a method for effectively producing the same, which comprises a metallic layer improved both in mechanical material strength and thermal stability of the joint strength to the ceramic substrate. This has been achieved effectively on the basis of an SHS technique.

This is an advanced variation of our previous applied invention which is based on a combined process of SHS with compression and in which metallic ingredients are molten with the intense heat of an SHS reaction and allowed to penetrate the skeletal structure of in situ formed ceramic material, so that the gaps within and among it are filled in. The product of compact structure exhibits a high resistance to both heat and abrasion that conventional techniques could not achieve.

DISCLOSURE OF INVENTION

The composite of the invention essentially comprises a substrate of metallic block and a functional or working layer of ceramic material with superabrasive particles, and is characterized by that the latter is joined to the former on a surface by means of molten metal which occurred in the course of the SHS process.

The composite of the invention is effectively produced by:

(1) mixing a composition of powders so formulated as to be capable of undergoing an SHS process to yield a ceramic product and forming into one or more pellets, with superabrasive particles being distributed at least in the region to serve finally as the working surface; (2) arranging the pellet or pellets in the adjacency of said metallic block to complete the material system, while securing in this system the presence of metallic material to be molten during the SHS process; (3) causing to initiate said process in said system, whereby said metallic material is molten at least partly as heated by the reaction heat; (4) exert compression with a press in 0.1 to 10 seconds from the completion of the process and holding for 2 seconds at least in order to secure the joint of the ceramic and metallic bodies.

PREFERRED EMBODIMENT OF THE INVENTION

Figure 1:
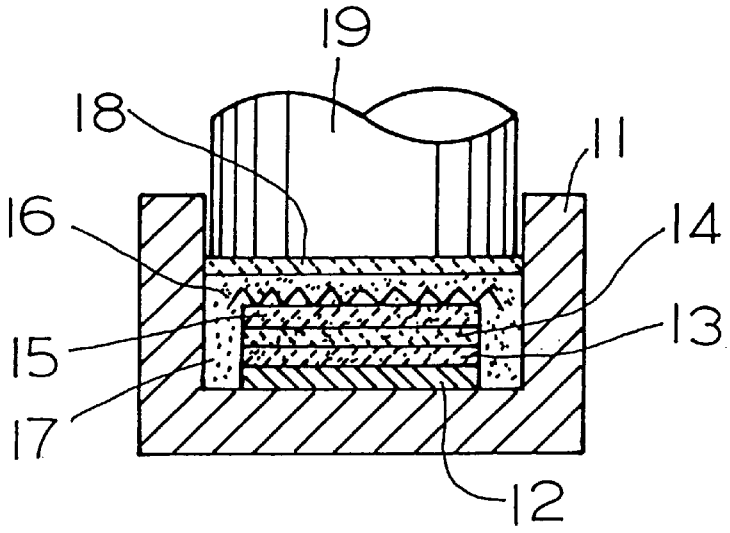
FIG. 1 shows the schematic illustration in section of the die used for carrying out example 1 below.

Suitable ceramic materials for the skeletal structure include systems comprising either one or more of carbide, nitride and boride of the fourth to sixth group transition metals of the Periodic Table, and SiC, $Si_3N_4$, and $B_4C$. Of those materials carbide, nitride and boride of titanium or silicon are especially preferred for the cost of production.

It is suggested for achieving a hard and compact composite product to use a starting material comprising both a composition which undergoes an SHS process to yield the hard material and another which provides melt when affected by the SHS process. So in the case of the mixture of TiC and Ti—Al, for example, a heat and wear resistant compact matrix can be obtained which comprises a skeletal structure of TiC with the gaps among and within it filled in with molten Ti—Al. The toughness of the ceramic layer can be improved by addition of nickel.

In the case of the combination of TiC—Ni and TiB2—Ni, on the hand, a tough and wear-resistant product can be obtained due to the formation of Ni and Ni—Ti phases. A wide variety of matrix composition is available for the composite of invention according to the use of the final product of compacted composite. Rather a hard product can be obtained from the material consisting, for example, of (60 to 90)(Ti or Zr), (3 to 12)(C or B), (2 to 18)Al, (1 to 5)TiH2, (1 to 7)Cu, and (3 to 20)(Ni or Co) in weight percentage. Or a wear resistant matrix composition can be achieved with the formulation of (60 to 70)(Ti or Zr), (3 to 12)(C or B), (2 to 18)Al, (1 to 15)TiH2, (5 to 25)(Mo or W), (1 to 7)Cu, and (3 to 20)(Ni or Co).

Common structural materials of ductile metal are employed for forming the substrate of the invention; appropriate material composition and size are selected to well match the fixture and post-treatment in correspondence with the particular end use.

The composite and metallic sections are bonded in a similar way to the welding. The short duration, of the order of a few seconds, of heat generation and use of metallic substrate effective for heat radiation only gives a limited zone in which melting or diffusion occurs, so the essential properties of the bulk of substrate metal remains least affected by such intense heat. Thus a substrate of hardened steel, for example, will be only affected and reduce in hardness in the adjacency of the joint, while the bulk of the functional structural body remains unaffected in properties. The substrate may be made of various grades of steel for common uses. SUS stainless steel (JIS) and copper also may be used for higher resistance to corrosion or weather, while titanium or aluminum based materials are preferred for a lighter construction. As some combinations of substrate metal and ceramic material may suffer cracking due to the difference in coefficient of thermal expansion at the interface of the materials, a transition layer of compacted powder of intermediate composition may be inserted between the two materials, forming as a whole an inclined functional material. The intermediate layer, as necessary, may consist of several sublayers; they are each made as a pellet, or compacted powder mixture, of stepwise varying compositions and the necessary number of them are arranged in stack between the functional and supporting bodies for the use as a starting material.

The short heating duration, of the order of a few seconds, in the SHS process does not allow a long distance of flow of melt for filling the gaps within and around the skeletal structures. So it is important for the purpose of forming an adequate stress relieving layer to vary the composition so that the proportion of metallic components relative to the ceramic materials is decreased in steps from the substrate end towards the ceramic functional end, thereby minimizing the discontinuity in resulting structure.

The metallic material for bonding the substrate metal to the ceramic layer should exhibit good tensile and bending strength, in addition to rather a high melting point. So nickel in particular is suitable; the TiC/Ni and TiB2/Ni are especially good as a heat resistant for common purposes, while SiC/Ni and Si3N4/Ni are suitable as a heat resistant material when used in an oxidizing atmosphere.

On the other hand, the combination of TiB2/Si is effective for achieving a wear resistance on the metallic surface, even if with rather a low toughness: a comparative abrasion test indicates an abrasion resistance result with this compound more than 100 times that of carbide alloy.

The synthesis of ceramic material is possible with the heat production by the SHS process of starting materials alone, by using a composition or combination to achieve a high adiabatic combustion temperature. Adequate combinations include, for example, a powder mixture of titanium or zirconium with carbon or boron, or nitride powder of silicon, titanium or zirconium with nitrogen (from the atmosphere).

Some functional layer compositions, however, may be insufficient in heat production for completing the process.

A chemical oven of formulated powder mixture is arranged in adjacency with the starting materials in order to make up and secure the heat requirement if they yield only a heat amount insufficient for sustaining the process, due to the functional layer composition intended.

When arranged in separation from the pellet of synthesis starting material, the widely used traditional combination of aluminum-iron oxide is also available for the chemical oven. This arrangement, however, yields molten iron, which tends to weld the product. Such problem can be avoided by using the Ti—C system, which does not involve liquid related troubles by quickly yielding the TiC product in solid form, while the mass of chemical oven products conveniently serves also as a compression medium at high temperatures. The chemical oven is also effective as a cooling retarder and minimizes cracking of the composite product due to the thermal deformation.

The chemical oven is also available for welding an unexothermic or insufficient heat generating composition of starting materials, in sheet or grains, to the substrate. For this purpose, heat resistant parts can be produced with a TiC or TiB based porous ceramic sheet joined to an SUS stainless steel substrate, by using a pellet or compacted nickel foil or powder mixture of Ti or Ni with C or B, as inserted at the interface between the functional layer of TiC or TiB based porous ceramic sheet and SUS stainless steel substrate.

Similarly, wear resistant products can be produced from a superabrasive containing mixture of WC—Co or WC—Ni powder, as formed, green fired or sintered, by heating from around with a chemical oven; in the product the functional layer skeletal structure consists of WC particles which are bonded together and as a whole to the substrate with Co or Ni.

Thus the use as a bonding medium of the melt occurring during the SHS process allows a joint of significantly improved strength over the traditional brazing and even comparable with the technique with fused metal under ultrahigh pressure at an elevated temperature. So the list of component groups available for the pellet of the present invention can be summarized as: (Ti, Zr, Hf, Si, Mo, W, Ta, Nb, Cr)—(C, B, N)—(Si, Ni, Co, Cu, Al), and the preferred combinations include: TiC—Ni, TiB2—Si, TiB2—Ni, SiC—Ni, Si3N4—Ni.

Diamond particles, as superabrasive contained in the wear resistant layer, can transform to graphite when exposed to the high temperature during the process. The graphite on the diamond surface decreases the strength of joint to the ceramic body and also the wear resistance. The rate of graphitization process is more dependent on the duration of the intense heat than the magnitude itself of the latter, so in the SHS process whereby diamond is subjected to the high temperature for a few seconds, graphitization damage is practically negligible for a size over 10 $\mu$m.

In case of possible damage to the superabrasive particles contained in the functional layer due to the excessive heat generation during the SHS process, the addition of neutral, stable compound as a diluent is also effective, such as carbide, nitride, boride and oxide, premixed in the ceramic starting materials For a functional layer with diamond particles, an additive to yield hydrogen during the process, such as TiH2, may be advantageously used in the matrix, in order to prevent the deterioration of diamond by graphitization, which oxygen promotes. As an ingredient neutral to the process, they should be used in specific proportion; an amount of 0.2 to 15 weight % is appropriate, with the preferred range being between 1 and 5%.

While it may be desired that for the use as a wear resistant material the functional layer surface be covered totally with superabrasive particles, the diamond content in the surface should not exceed anyway 80% by volume, in consideration of the retention to be secured by the matrix. The lower limit is advantageously set between 25 and 60%, with a fair performance at 10%, though.

For the superabrasive particles used in the ceramic body, retention of diamond particles to the matrix can be effectively improved with a coating on the surface. Good results are achieved with a coating of transition metal of group IV, V, and VI in the Periodical Table, including Ti, Cr, Mo and W, as well as their carbide, nitride, and boride. Traditional techniques are available to deposit the coating, such as vapor deposition, CVD, and dipping for the transition metal. A firm joint is created between the coated metal and superabrasive substrate by means of their compound which is formed at least partly from the ingredients at the interface, in the SHS high temperature condition during the preparation of the tool material.

With the coating being effective for protecting the superabrasive substrate from the intense heat and abrupt temperature change, a wider variation of matrix compositions is available by allowing to produce extremely high temperature over 2000° C. The coating also serves as a barrier against the atmospheric oxygen and impedes its contact and resulting promotion of graphitization.

For wear resistant products prepared in an SHS process, it is often demanded that the functional surface alone have such property, while the bulk body including the substrate exhibit a good machinability precisely to the specification given, so the construction with a monolayer of superabrasive particles on the functional surface alone is sufficient for most cases of application. For applications as a tool material, such design, however, achieves rather short tool life, for a demerit. Overcoming this problem, a machinable wear resistant product of sufficient thickness can be obtained by forming a wear resistant functional layer, with superabrasive particles distributed throughout the bulk of matrix, while a backing is made of the same material as said matrix (but without superabrasive particles) and is arranged contiguously between the functional layer and substrate, in support of the former.

In the invention the starting material is conveniently and normally compacted into a pellet before it is loaded in the reactor. Since the product is often hard and, in particular, the superabrasive containing layer is almost impossible to machine, the pellets should be designed and molded into the final form as closely as possible, taking into consideration the shrinkage during the sintering process. In the production of wheel forming dresser of TiB based matrix scattered with diamond particles, for example, the pellet is prepared either by forming in the die with a cavity of final product dimensions or first forming into a cylindrical or prismatic pellet, which is then machined to the final shape before it is subjected to the SHS process. In the case of the former, a pellet may be prepared with diamond particles deposited on the working surface alone, by spreading them in the die cavity area corresponding to the working surface, or by fixing them with adhesive in advance, then filling the matrix ingredient materials, and pressing into the form.

As the preparation of a wear resistant product with curved surfaces takes steps of placing pellets of starting materials contiguously in adjacency with- and exerting a pressure onto such curved substrate, isotropic compression can be achieved to a degree by using molding sand as a compression medium.

The use of molding sand is also effective for forming a wear resistant lining on the inside surface of a pipe or a valve. In such working with hollow parts the substrate is available as a pressure vessel, and a large temperature gradient may be provided between the substrate and functional layer, by cooling the outside surface of the substrate by natural or forced ventilation.

Ceramic materials in general show good resistance to compression but poor to tension. For the composite produced by the invention, however, the functional layer is under compression at room temperature, due to the smaller coefficient of thermal expansion with the functional layer than with the metallic substrate, as confirmed by the observation of the lattice parameter for the metallic phase in the ceramic body at- and in the adjacency of the interface. Further the use as a heat resistant material may usually hold the ceramic side towards the higher temperatures and thereby in compression favorably. Special care should be taken, however, in the designing of a product of blocky form, so as to secure that the functional layer side be steadily in compression.

The density of a pellet as formed should not exceed 75% the theoretical value for use in a process in which the temperature rise, necessary for the sintering, is essentially achieved by the chemical reaction within the pellet, while the pellet should be compressed as densely as possible by means of CIP or any other technique available, for a process where the necessary heat is basically supplied from a chemical oven outside the pellet.

The formed pellet is mounted on a compression system, which is equiped with an igniter (that is a graphite or metallic heater, for example). For the compression system available are such known techniques as die press, hot press system or HIP system.

A system with a closed work chamber can be conveniently adapted to the preparation of a nitride based matrix in a nitrogen atmosphere, more compact product by securing in a vacuum the removal of gas which may evolve during the process, or product with minimized deterioration of diamond or matrix due to oxidation by treating in a hydrogen atmosphere.

A piece of insulator should be conveniently inserted between the pellet and die, in order to maintain the process temperature and at the same time for the protection against the deformation or damage to the die, although a hot pellet may be compressed immediately in some applications.

Molding sand, as filled and pressed around a pellet, serves as insulator and good pressure medium, as well, to give a quasi-isotropic compression. This is especially useful in the production of blocky form products.

With a hot press system, matrix compositions of insufficient heat generation also can be processed by properly operating the attached heating system. The latter is also available as an igniter.

When a HIP system is used for compression of the pellet, the latter is formed densely, enclosed hermetically, degassed and sealed, and subjected to the process in an arrangement with an SHS heating mixture (that is chemical oven) around. The attached heating system is also available as an auxiliary heater or igniter.

When necessary, a tool support blank may be placed together with the pellet for joining. For example, a round rod tip of steel, as a segment of drill shank blank, may be placed in the die together with a formed pellet which is surrounded by a chemical oven composition, so the composite compact may be welded to the substrate of steel at the same time as it is is formed. This technique causes no essential damage to the property of the hardended steel substrate as the intense heat generation takes place in a restricted zone which moves. As demanded, a cooling system also may be arranged on the back side of the metallic substrate, so that a large temperature difference is provided there from the site of reaction and, thereby, the essential properties of the substrate material is secured, while the functional layer is imparted of resistance to heat or wear.

The pellet, loaded in the system, is ignited to initiate the SHS process under no or slight compression. An easy burning powder mixture may be inserted between the pellet and heater for facilitating to induce the burning of the pellet. A pressure of suitably 10 to 200 MPa is held for 2 to 150 seconds and, preferably 2 to 60 seconds, by starting immediately after the combustion flame has reached the other end of the pellet and the latter as a whole is heated at a sufficiently high temperature (or within 0.1 to 10 seconds of the termination of combustion).

The composite material obtained by the invention had a superabrasive containing ceramic layer which is firmly joined to the substrate of common metallic material, with the joint comparable with that achieved in the ultrahigh pressure high temperature technique. So they can be successfully employed in various uses, as a planar wear resistant parts including sliding plates, bearing components and surface plate, or as a blocky wear resistant parts including nozzle, bent pipe lining, and die core, as well as various grinding and cutting tools and wheel tips.

In the composite products of the invention, when a hot press technique is utilized, the superabrasive containing ceramic material in the functional layer is joined and welded to the metallic substrate during the synthesis and compaction of the ceramic product, a firm joint or welding is achieved at the interface by the co-melting of certain functional layer components and metallic substrate components and, thereby, forming a single integrated structure. Further the characteristic limited heating zone of the SHS process results only in minimum thermally affected zone, so the often demanded properties of toughness, good workability and light weight can be secured.

While residual stresses have raised a serious problem to a composite product prepared under an ultrahigh pressure technique, they can be moderated now by using a lower hardness metal become now available.

An improvement can be achieved by the invention in material weight and cost, and that no or little work is necessary with the substrate.

In short, the present invention, based on the combined techniques of the SHS and various compaction, allows to prepare a diamond containing tool or construction parts of essentially increased dimensions over conventional techniques with ultrahigh pressure.

EXAMPLE 1

A starting material was prepared from 1:1 mixed powder of 22 μm (nominal size; effective and saved hereinafter unless otherwise indicated) titanium and 7 μm carbon, by adding 25 wt % nickel powder (under 300 mesh). It is then formed in a die into a square pellet of 100×100×5 mm.

Another dose of mixed powder of starting material composition was admixed with 30% by volume of 20/30 μm diamond powder and compressed into a second pellet of the same dimensions. The arrangement shown in FIG. 1 was used for further operation.

In the die 11 first placed a 100×100×3 mm wide SUS stainless steel plate 12, then the first formed pellet 13 and at the top the second pellet 14.

Over the assembly spread was 30 grams of 1:1 (in molecular ratio) mixed powder of Ti and C as an igniting medium 15 and a graphite heater 16. The space between said assembly and die 11 was filled with molding sand 17; a punch 19 was laid over it with an insulator sheet of ceramic 18. The graphite heater 16 was turned on to ignite the specimen; 2 seconds after the termination of combustion, the punch 19 was driven to exert a pressure of 100 MPa to the specimen and held for 30 seconds. The resulting product was a fine structured ceramic body joined firmly to the SUS plate, the former composed of a skeletal structure of TiC with the gaps around it filled mainly with Ni as well as Ti—Ni intermetallic alloy; it was used successfully as a wear-resistant tile.

EXAMPLE 2

An excavator edge was tentatively prepared. Powders of 22 μm Ti, 7 μm carbon and under 325 mesh Al were dosed in a Ti:C:Al proportion by weight of 73:11:16 (16) and mixed well to prepare the matrix starting material. The latter was admixed with 1 wt % of TiH2 and further with 25 volume % of 40/60 μm diamond particles, mixed fully and formed in a die at a pressure of 10 Mpa into truncated conical pellet which measured 40 mm across at the base and 10 mm thick, with a point angle of 120 degree.

Figure 2:
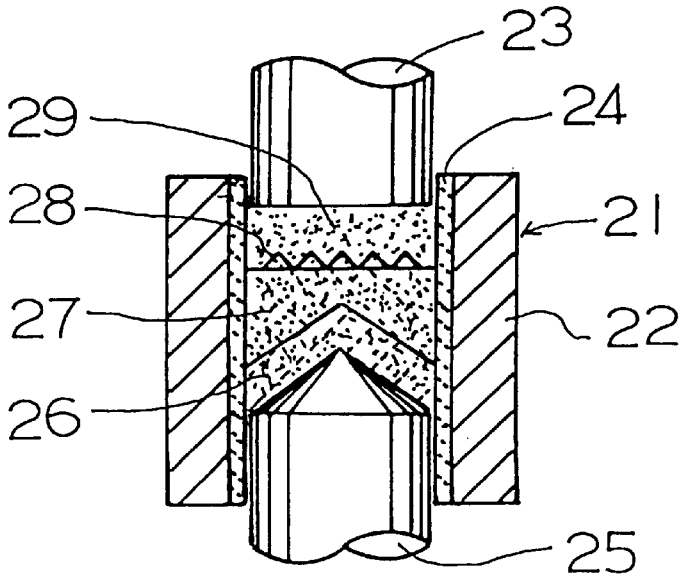
FIG. 2 shows the schematic illustration in section of the die used for carrying out example 2.

The arrangement shown in FIG. 2 was used, in which the die set 21 comprised a core 22 with a bore 40 mm across and 65 mm long, and a punch 23. A sleeve 24 of sintered mullite is fitted inside the core 22. A support member of SUS stainless steel 25, conically pointed at an angle of 120 degrees was set in the core 21 at the bottom, then the pellet 26 was placed over it. Over the pellet, 30 grams of 1:1 Ti—C mixed powder 27 was loaded and graded, then came an igniter of graphite ribbon 28, which was covered with molding sand 29 to a thickness of 20 mm. The punch 23 was set at the top. A thermocouple (not shown) was so arranged as to be in contact with the bottom of the pellet through the 2 mm across axial hole provided at the center of the support member.

The ready assembly of die set was mounted on a monoaxial hydraulic press, and current was passed to the graphite ribbon to ignite the pellet without dreiving the press. When a temperature of 1800 degrees C. was attained at the pellet bottom, the press was operated to quickly compress the work and hold a pressure of about 100 Mpa for 40 seconds. The recorded cycle parameters indicated that the compression started about 0.5 second after the termination of combustion.

The recovered product exhibited metallic luster in the matrix region, which was analyzed by XRD to consist of TiC and TiAl. Optical microscopy in the ground area showed a uniform distribution of diamond particles in the matrix, while XRD indicated no trace of graphite formation on the surface of diamond particles.

EXAMPLE 3

The functional layer material was composed of 80Ti/20B mixed powder, which was further admixed with 33 vol. % of 12/25 μm diamond particles. The die with a 75 mm across cylindrical cavity was loaded of a 10 mm thick SUS plate at the bottom, then a 0.5 mm thick Ni sheet, over which 40 grams of Ti—B mixed powder with diamond particles was spread and graded. Then came 25 grams of of 1:1 (in molecular ratio) Ti—C mixed powder as a chemical oven at the top.

Further a graphite igniter was placed; it was covered with a 10 mm thick layer of molding sand, on which the upper punch was arranged.

The process temperature was monitored by means of a thermocouple which was set in the through hole provided in the SUS plate at the center, while the heating and compression was conducted as in example 1.

The product was a wear resistant composite body of 2 mm thick TiB layer deposited on the SUS steel plate, and EPMA conducted on the product section showed a 1 mm wide gradient in Ni concentration from the interface to the working surface, and indicated the contribution of Ni to the bonding within the layer of TiB and as a whole to the substrate member.

The recovered product was wire-cut and ground at the tip to be used as a cutting tool edge for wood machining.

EXAMPLE 4

A mixed powder of 65Ti/11B/4Cu/19Ni/1TiH2 (wt %) was used for the material of functional layer. 40 vol. % of this powder was admixed with 60 vol. % of 0.5 μm thick Ti coated 30/40 μm diamond particles and fully mixed, and formed into a pellet 98 mm across and 2 mm thick. It was placed on an SK carbon steel plate 98 mm across and 5 mm thick, and together put in a die cavity 100 mm across lined with mullite ceramic, over which 1:1 Ti—C mixed powder was spread to a thickness of about 10 mm as an igniting medium for facilitating the ignition, and further a graphite igniter. The operation of example 1 was repeated from ignition to compression. The product was cut and polished before it was used as a machine tool.

EXAMPLE 5

Figure 3:
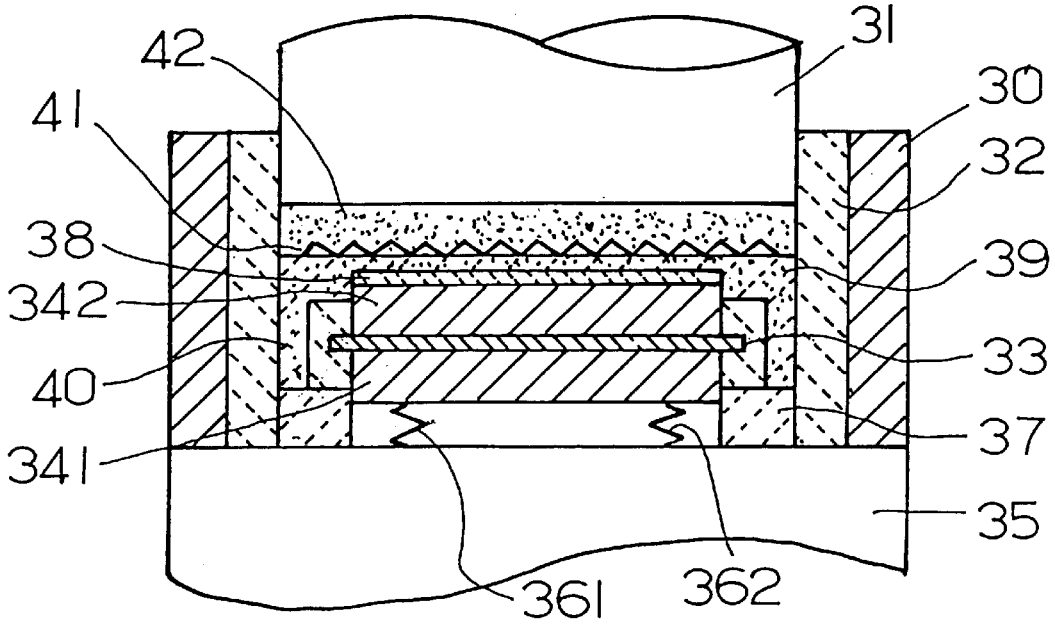
FIG. 3 shows the schematic illustration in section of the die used for carrying out example 5.

The die arrangement as schematically illustrated in FIG. 3 was used which comprised an encasement 30 with a bore 100 mm across and a punch 31, and a mullite sleeve 32 was tightly fitted inside the encasement. A circular saw blade blank 33 of 75 mm diameter and 1 mm thickness was placed in it with a 65 mm across, 15 mm thick cylindrical block of steel 341, 342 on each side, for the purpose of heat radiation from and prevention of deformation of said blade blank during the SHS process. On the work table 35 the assembly was placed as supported from below with springs 361, 362 inside the ceramic receiver ring 37, with a ceramic sheet 38 laid over on the upper block 342 for heat insulation. Said blank 33 was surrounded with a 5 mm across, 3 mm thick annular pellet 39, which comprised for composing the matrix mixed powder of 60Ti/10C/10Al/3TiH2/5W/5Cu/7Ni (in wt %), admixed with 20% of coated diamond particles (in particular, 120/150 μm substrate diamond particles coated with 2 μm thick Mo deposit). The space around the cylindrical wall of the pellet 39 was filled with equimolar mixed powder 40 of Ti and C as a chemical oven material. The remaining space was filled of molding sand 42, while a heater 41 was arranged in adjacency with the mixed powder 40 at an end. Compression was started about one second after the termination of combustion, and a pressure of 100 MPa was exerted on the pellet for 30 seconds. The product was effective as a blade for cutting ceramic blocks.

EXAMPLE 6

Diamond powder, coated with 2 μm thick Mo and 1 μm thick Cu inside and outside layers on the 120/150 mesh substrate was provided, and 15 vol % of it was admixed to the metallic powder of matrix composition of 65Ti/23Co/12Al (in wt. %), and formed into a truncated conical pellet of 10 mm tip diameter, 20 mm base diameter and 15 mm thickness. It was placed in the 40 mm across die bore in abutment to an SK steel round rod of 17.5 mm diameter at one, surrounded by a 5 mm, approximately, thick layer of 1:1 Ti/C mixed powder for inducing burning, and filled with molding sand after the arrangement of the ignition heater. The die was placed in a hermetic container and the inside space was degassed and then filled with nitrogen; after that the process was initiated by igniting. Compression was started 4 seconds after the ignition, and a pressure of 100 MPa was held over the pellet for 20 seconds. The product had a construction of matrix which comprised a functional layer joined firmly to a substrate of SK steel, with the former comprising diamond particles distributed and secured in the matrix of TiN, TiAl, TiCo or the like, and was used as a dresser.

EXAMPLE 7

70:30 (wt. %) mixed powder of under 20 μm Ni/Al was used for the matrix composition. The superabrasive was 0.2 μm thick W coated 6/8 μm diamond particles. 20 vol. % of it was admixed to said matrix composition and formed into a first pellet of 150 mm O.D., 100 mm I.D., and 5 mm thickness, while the pure matrix composition without superabrasive content was formed into a second pellet of the same O.D. and I.D. but 8 mm thickness. The die arrangement of FIG. 4 was used to prepare a type 6A2 cup wheel with a silumin blank.

Figure 4:
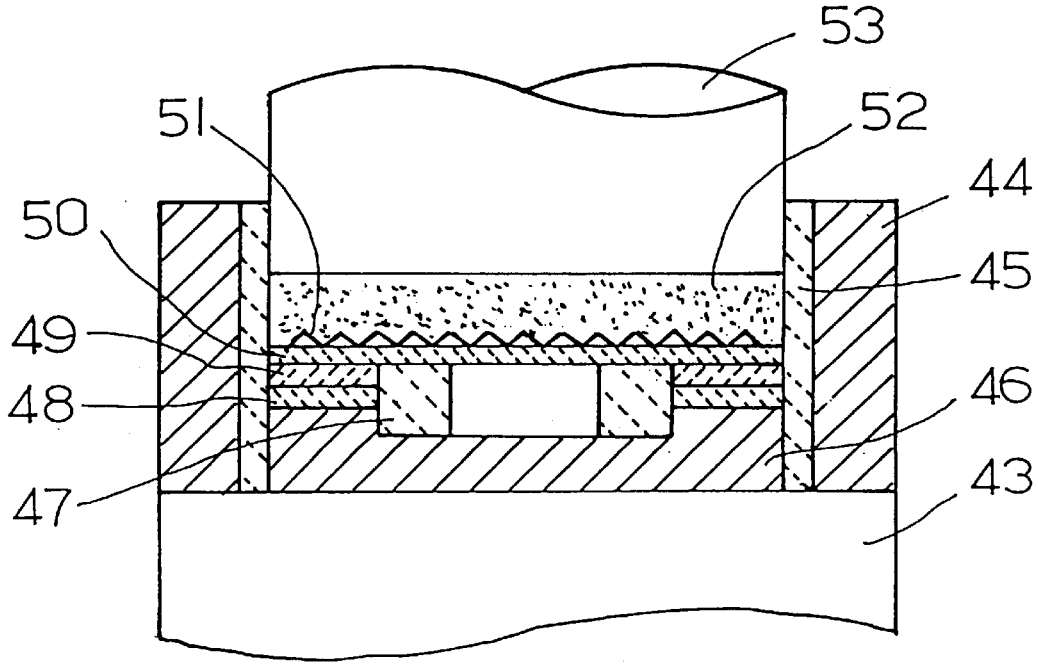
FIG. 4 shows the schematic illustration in section of the die used for carrying out example 7.

On the work table 43, as shown in FIG. 4, a wheel was prepared using a 155 mm bore die encasement 44. With the bore lined with a 2 mm thick ceramic sheet 45 for heat insulation, the inside space was filled with, from bottom to top, wheel blank 46 and, in alignment with said sleeve 47, the second pellet 48, and the first pellet with diamond particles 49. Further a 3 mm thick layer of 1:1 (in molecular ratio) mixed Ti/C powder 50 of was laid, an ignition heater 51 was arranged, and 20 mm thick layer of molding sand 52 laid. Compression was exerted one second after the ignition, and a pressure of 50 MPa was maintained for 20 seconds.

The product, with a NiAl matrix in which diamond particles were firmly held and distributed up to a depth of an approximate 3 mm in the surface region, was used effectively in a lapping wheel.

EXAMPLE 8

Mixed powder of 60Ti/20B/20Ni (in wt %) was used for composing the matrix. 20 vol. % of coated diamond particles, with 40/60 μm diamond deposited with 4:6 (in wt %) W—Mo alloy, was admixed to said mixed powder for the matrix, and formed into a circular pellet of 50 mm diameter and 10 mm thickness. The substrate was a circular copper plate 50 mm across and 10 mm thick, while a 0.5 mm thick nickel sheet was inserted between the substrate and pellet. The steps to follow were conducted as in example 3, with a corresponding die and material arrangement.

The product showed a matrix of TiB, TiB2 and TiNi, holding firmly diamond particles, and joined well as a whole to the copper substrate.

EXAMPLE 9

A 73:11:16, in weight ratio, mixed powder of Ti, graphite and Al, was prepared by using the same set of materials as in example 2 for the matrix. This powder was further mixed with 80/100 μm cubic boron nitride particles, deposited with 2 μm thick Mo layer at a volume ratio of 1:1, and formed into a circular pellet of 30 mm diameter and 5 mm thickness. The sintering process was conducted in a 50 mm bore die, by using a 3 mm thick SK steel plate for the substrate, while a 0.2 mm thick Ni sheet was inserted between the pellet and substrate. Such pellet was placed in the die, as surrounded by a 10 mm thick layer of 1:1 Ti/C mixed powder as a chemical oven composition. Compression was started at the time a temperature of 2000 degrees C. was attained at the pellet bottom, and a pressure of 80 MPa was maintained for 30 seconds. The product recovered was cut and machined into a tool tip and used for grinding steel works.

EXAMPLE 10

Figure 5:
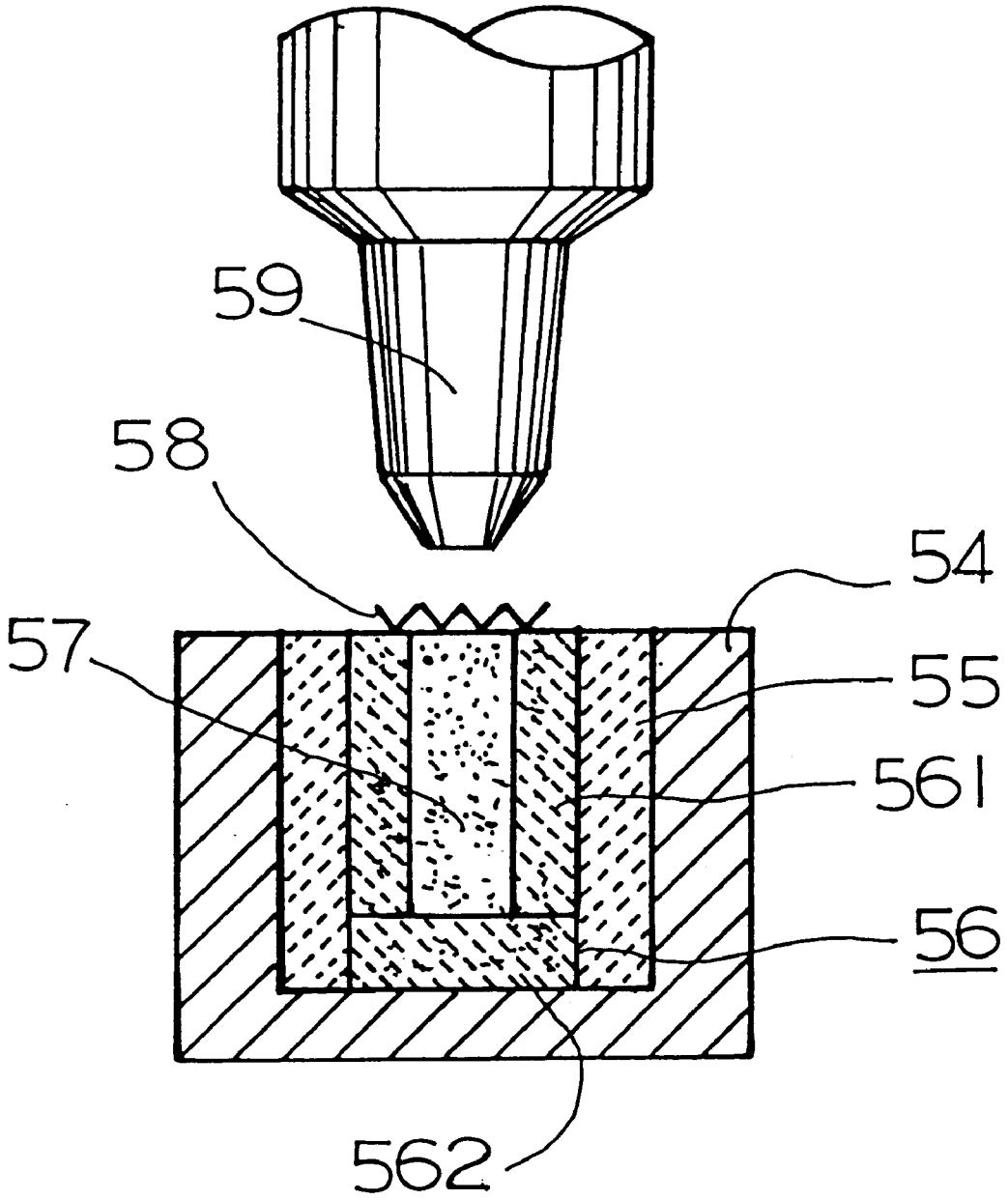
FIG. 5 shows the schematic illustration in section of the die used for carrying out example 10.

35:65 (in weight ratio) Ti/Ni mixed powder was formed into a 10 mm thick cylindrical first pellet 55 and placed in the 50 mm I.D. and 50 mm length bore of a cup-shaped copper die 54 in a peripheral abutment to the wall, as schematically shown in FIG. 5. Both another hollow cylindrical pellet 561, with 30 mm O.D., 15 mm I.D. and 40 mm length and a solid cylindrical pellet of 30 mm O.D. and 10 mm thickness 562 were formed by composing of 40 vol. % 30/40 μm diamond particles and the balance of 70:30 (by weight) Ti/B mixture, and were arranged as a set of second pellets 56 in the peripheral abutment inside the first pellet 55. The space inside said second pellets 56 was filled with 80:20 Ti/C chemical oven composition 57, with a graphite heater 58 arranged properly. A punch of alumina 59 was used for the compression after the process. The product as recovered was ground on the inside surface and used as a sample nozzle for a water jet machine.

EXAMPLE 11

A twist drill blank of 30 mm diameter and 60 mm length was prepared from 88WC-12Co carbide alloy, with a groove 8 mm wide and 5 mm deep for formed on the site of edge. An 0.1 mm thick Ta sheet was wrapped around said blank, and held vertical in an alumina tube along the 60 mm bore axis. Said groove was filled with 70:30 (by weight) Ti/B mixed powder, admixed with 45 vol. % 30/40 μm diamond particles, while the space defined by the Ta sheet and alumina tube wall was filled with 80:20 Ti/C mixed powder, as a chemical oven composition.

A graphite heater was arranged at one end of the Ti/C mixture, and the whole was placed in a pressure resistant vessel of 120 mm I.D. and 180 mm height, which then was degassed. Nitrogen was introduced 5 seconds after the ignition from the cylinder source that was directly connected with said vessel, and filled to a pressure of 10 MPa.

The product, with a recess occurring at the groove, was ground with a centerless grinder to an O.D. of the carbide of 22.5 mm, then an edge was was created.

EXAMPLE 12

A circular plate 125 mm across was prepared by using the materials and conditions specified in Table 1 below at run numbers 1 to 12, for the use as a wear resistant material or tool blank. In each case, a die of 200 mm I.D. was used, with a 5 mm, approximately, thick superabrasive containing matrix layer and a 10 mm thick substrate. The powder sizes used were 22 μm for Ti, 7 μm for C and under 300 mesh for the others. The intermediate zone refers to a matrix portion without superabrasive particles. The thickness of chemical oven layer was approximately constant at 10 mm. The compression was a quasi-isotropic, as conducted by means of molding sand, and started 5 seconds after the ignition, while a pressure of 5 MPa was maintained for 30 seconds.

TABLE 1

| | | superabrasive | | | transition | adhesive layer | | | | |
|---|---|---|---|---|---|---|---|---|---|---|
| run no. | matrix composition (weight ratio) | material | size μm | content vol % | layer thickness | nature | thick-ness | substrate | chemical oven | process atmosphere |
| 1 | 18Ti—69W—13B | diamond | 12/25 | 30% | 2.0 mm | Ni plate | 0.5t | SK* steel | TiB | vacuum |
| 2 | 27Ti—54Mo—19B | cBN | 20/30 | 40% | — | Ni pellet | 1.0t | SUS* steel | Ti:B | |
| 3 | 94W—6C | diamond | 8/16 | surface layer 70% | — | — | | Ni plate | Ti:C | |
| 4 | 70Ti—10Al—20B | cBN | 30/40 | 25% | 1.5 mm | — | | silumin | — | vacuum |
| 5 | 50Ti—30Si—20B | cBN | 8/16 | 30% | — | Ni plate | 0.5t | Ti | — | Ar |
| 6 | 42Mo—43Zr—15B | diamond | 8/16 | 20% | 2.0 mm | Ni plate | 0.5t | SK* steel | — | Ar |
| 7 | 50Al—50Ti | diamond | 12/25 | 25% | 2.0 mm | Ni—Al pellet | | SUS* steel | — | $N_2$ |
| 8 | Si | diamond | 4/8 | 20% | — | Ni plate | 0.5t | Cu | — | $N_2$ |
| 9 | 60Ti—40Ta | cBN | 4/8 | 25% | — | Al plate | 1.0t | Ni | — | $N_2$ |
| 10 | 80Ti—20Ni | diamond | 20/30 | 30% | 2.0 mm | — | | SK* steel | — | $N_2$ |
| 11 | 50Si—50B | diamond | 4/8 | 20% | — | Ni plate | 0.5t | SK* steel | — | $N_2$ |
| 12 | Ti—Si | diamond | 12/25 | 35% | — | — | | Ni plate | | $N_2$ |

*Designation according to the Japanese Industrial Standards

Industrial Applicability

The composite material of the invention can be employed in various uses as a planar wear resistant material, including sliding plates, bearing parts and surface plate, or blocky wear resistant parts such as nozzle, bent pipe lining and die core, as well as abrasive tips for various types of tools.

What is claimed is:

1. A superabrasive containing composite, comprising: layers of a substrate portion of shaped metallic block and a functional portion of ceramic material which comprises a working surface containing superabrasive particles, the latter layer being joined on a surface of said substrate by means of molten metal which occurred during an SHS process, and said ceramic material forming a skeletal structure and comprising a carbide, nitride, carbon-nitride, boride, or silicide of a group IV transition metal or aluminum, boron carbide, or a mixture thereof, and a metallic material filling the gaps within and among said skeletal structure.

2. The composite as claimed in claim 1, in which said ceramic material is a product formed in situ by a self propagating high temperature synthesis (SHS) process.

3. The composite as claimed in claim 1, in which said molten metal comprises as the basic component at least one selected from iron group metals, copper, aluminum and transition metals.

4. The composite as claimed in claim 1, in which said functional portion has a matrix which essentially consists of ceramic materials.

5. The composite as claimed in claim 1, in which said ceramic portion comprises the structural and filling materials at a proportion which varies from the working surface to the substrate interface continuously or in steps.

6. The composite as claimed in claim 1, in which said functional portion has a thickness of 0.5 to 20 mm.

7. The composite as claimed in claim 1, in which said superabrasive particles are distributed at least on the surface of said ceramic layer.

8. A method of producing a superabrasive containing composite, comprising:

(1) forming a powder mixture that is capable of undergoing an SHS process to yield a ceramic product into one or more pellets, while admixing superabrasive particles into said powder mixture at least in an area which will serve as a working surface, (2) placing said pellet or pellets in the adjacency of a substrate of a shaped metallic block to provide a starting material system, while securing in said system a first chemical composition with a metallic component which is capable of melting during the SHS process, (3) initiating the SHS process within said system and thereby heating and melting at least partly said metallic component, and (4) exerting a pressure with a press by starting within 0.1 to 10 seconds of the termination of the process and holding for at least 2 seconds and thereby joining the in situ formed ceramic product and said metallic block.

9. The method as claimed in claim 8, in which a second chemical composition capable of undergoing an SHS process is arranged separately from but in adjacency with said pellet and metallic block, and the heat of melting said metallic component is supplied at least partly by the SHS process of said second chemical composition.

10. The method as claimed in claim 8, in which the heat of melting said metallic component is supplied totally by the SHS process within said pellet.

11. The method as claimed in claim 8, in which said ceramic material comprises at least one selected from carbide, nitride, carbo-nitride, boride, silicide of a group IV to VI transition metal and aluminum, and boron carbide.

12. The method as claimed in claim 8, in which said metallic component is used in powder, mixed with the ceramic forming materials and distributed in the pellet.

13. The method as claimed in claim 8, in which said metallic component is formed and used as a second pellet and arranged between the first pellet of ceramic forming powder mixture and said metallic block.

14. The method as claimed in claim 8, in which said metallic component is formed and used as a sheet and arranged between at least one pellet of ceramic forming material powder mixture and said metallic block.

15. The method as claimed in claim 8, in which said metallic component is yielded in and supplied from said substrate during the SHS process.

16. The method as claimed in claim 8, in which said metallic component comprises at least one selected from iron, copper, aluminum and transition metals.

17. The method as claimed in claim 8, in which said powder mixture comprises at least one metal of titanium and silicon, and/or one refractory substance selected from their carbide, nitride and boride.

18. The method as claimed in claim 8, in which said compression technique is one selected from direct compression in a die, quasi-isotropic compression with pressure medium and roll pressing.

19. The method as claimed in claim 18, in which said pressure medium comprises molding sand.

20. The method as claimed in claim 18, in which said pressure medium comprises the product of the SHS process.

* * * * *